8-109 SR
FIP8309 OR 4,120,650

United States Patent [19]
Kappler et al.

[11] 4,120,650
[45] Oct. 17, 1978

[54] LAUNDERING PROCESS FOR DUAL BLEACHING STAINED FABRICS

[75] Inventors: Frank Robert Kappler, Wyandotte; Roma Jean Killian, Melvindale; John Joseph Cramer, Grosse Ile, all of Mich.

[73] Assignee: BASF Wyandotte Corporation, Wyandotte, Mich.

[21] Appl. No.: 857,675

[22] Filed: Dec. 5, 1977

[51] Int. Cl.[2] ..... D06L 3/06
[52] U.S. Cl. ..... 8/109; 8/111; 8/137; 252/95
[58] Field of Search ..... 8/109, 108 A, 111, 137; 252/95

[56] References Cited

U.S. PATENT DOCUMENTS

| | | | |
|---|---|---|---|
| 3,077,372 | 2/1963 | Smolens et al. | 8/109 |
| 3,265,462 | 8/1966 | Rogers | 8/109 |
| 3,281,202 | 10/1966 | Helmick et al. | 8/109 |
| 3,481,684 | 12/1969 | Sando et al. | 8/111 |

*Primary Examiner*—William E. Schulz
*Attorney, Agent, or Firm*—Andrew E. Pierce; Bernhard R. Swick; Robert E. Dunn

[57] ABSTRACT

Stained textile fabrics, especially cotton-polyester, rayon-polyester blends stained in use with blood stains, can be reclaimed and returned to use by the process of washing and bleaching said fabrics in the presence of a non-ionic or anionic surface-active agent, together with an oxygen-releasing bleaching agent and a chlorine-releasing bleaching agent, said bleaching agents used either successively or simultaneously. The laundering process involves the use of aqueous solutions of bleaching agents at elevated temperatures and at high pH. The process of the invention provides a synergistic improvement in the removal of stains as compared with the use of either an oxygen-releasing bleaching agent or a chlorine-releasing bleaching agent. The process can include a hot aqueous acid sour treatment to remove rust stains and an aqueous sour to neutralize alkalies in the bleached fabric. The treatment can be completed in a period of time of about 30 to about 90 minutes.

14 Claims, No Drawings

LAUNDERING PROCESS FOR DUAL BLEACHING STAINED FABRICS

BACKGROUND OF THE INVENTION

1. Field of the Invention

This invention relates to the removal of stains from fabrics and more particularly to the removal of blood stains from garments.

2. Description of the Prior Art

It is known in the prior art to utilize a two-stage process for bleaching cotton cloth in a textile mill wherein said process is a continuous process utilizing a hypochlorite-hydrogen peroxide bleaching system. In U.S. Pat. No. 3,265,462, such a process is disclosed in which cotton cloth is sequentially treated with an aqueous solution of sodium hypochlorite in the presence of a non-ionic surface-active agent and thereafter treated with an aqueous solution of hydrogen peroxide and sodium silicate. A similar continuous process for the bleaching of cotton cloth in a textile mill is disclosed in U.S. Pat. No. 3,481,684 wherein cotton or synthetic fabrics are treated successively with aqueous solutions of sodium chlorite containing an anionic surface-active agent and thereafter treated with an alkaline hydrogen peroxide solution. It is apparent that the bleaching processes of the prior art utilizing a combination of aqueous solutions of sodium hypochlorite and hydrogen peroxide entail the bleaching of textile fabrics to remove the natural discoloration inherent in cotton or synthetic fabrics as a result of processing in the textile mill rather than the removal of diverse stains incurred during the use of wearing apparel.

In U.S. Pat. No. 3,525,695, there is disclosed a laundry washing process for bleaching stained cloth wherein the stains are those caused by wine, tea, coffee, cocoa, fruits, etc., in which a peroxide compound is utilized at a temperature above 60° C. to remove said stains. There is no indication in the prior art that a combination of chlorine-releasing bleaching agents and oxygen-releasing bleaching agents would be effective in removing stains from cotton or synthetic fabrics made up into garments and therefore it is unexpected that the process of the invention provides synergistically improved results in the removal of diverse stains especially in the removal of blood stains.

SUMMARY OF THE INVENTION

There are disclosed processes for reclamation of stained fabrics by the removal of stains from fabrics, such as stained bed sheets, pillow cases, napkins, etc., and garments such as uniforms, aprons, handkerchieves, etc. said stains comprising stains caused by rust, sauces, household stains, etc., and especially stains caused by blood. Stained fabrics comprising cellulosic, i.e., cotton and synthetic fibers, i.e., cotton-polyester and rayon-polyester blend fibers can be readily reclaimed by the process of the invention. The fabrics to be reclaimed may also contain a synthetic resin finish designed to improve wrinkle-resistance and hand of the fabrics. By the process of the invention, stained fabrics are treated at elevated temperature with aqueous solutions comprising (1) a combination of oxygen-releasing bleaching agent and a chlorine-releasing bleaching agent in the presence of a non-ionic or anionic surface active agent or, alternatively, (2) the successive treatment of stained fabrics with either (a) an oxygen or a chlorine-releasing bleaching agent in the presence of a non-ionic or anionic surface-active agent and (b) a successive treatment of stained fabrics with an oxygen-releasing agent in the presence of a non-ionic or anionic surface active agent where the prior treatment (a) was with a chlorine-releasing bleaching agent. Conversely, a non-ionic or anionic surface active agent and chlorine-releasing bleaching agent is used where the prior treatment was with an oxygen-releasing bleaching agent. The process of the invention can include as an optional pre-treatment an aqueous treatment at elevated temperatures of the stained fabric with a rust-removing acid sour and an optional post-treatment with an acid sour to remove residual alkalies from the fabric.

By the process of the invention, the combination of at least one non-ionic or anionic surface active agent and an oxygen-releasing bleaching agent and said surface active agent and a chlorine-releasing bleaching agent in either successive or simultaneous treatment of stained fabrics, provides an unexpected synergistic improvement in the removal of various stains, especially blood stains, from the fabric. The removal of stains from synthetic fabrics including cotton and polyester blends or rayon and polyester blends, which is a particularly difficult task, is readily effected by subjecting such fabrics to treatment according to the process of the invention. Thus, often it is possible to reclaim and return linen and garments to service which by normal washing and bleaching procedures would be discarded because the stains were not possible to remove using normal bleaching procedures. It is particularly unexpected that the process of the invention would provide 100% stain removal from linens and garments to provide a clean, sanitary, like-new condition without excessive bursting strength loss in such reclaimed linens and garments.

DESCRIPTION OF THE PREFERRED EMBODIMENTS

Commercial laundries are often faced with the problem of removing stains from linens and garments so as to return them to a clean, sanitary, like-new condition or else removing such linens and garments from service. Prior to the present invention, certain stains, particularly rust and dried on blood stains, have been so difficult or impossible to remove utilizing a single or repeated washing and bleaching step that such linens and garments had to be removed from service thus necessitating a substantial loss to the owner thereof. In addition to all cellulosic fabrics, the popular polyester-cotton and polyester-rayon blend fabrics are particularly subject to stain retention through normal washing and bleaching processes, and thus are particularly difficult to return to clean, sanitary, like-new condition subsequent to staining with embedded soil, grease, salad oil, rust, gravy, medicinal stains, and particularly blood and meat juice stains.

While the process of this invention is particularly suited to the removal of stains from undyed linens and wearing apparel consisting of cellulosic fabrics and fabrics containing blends of cellulosic and synthetic fibers, the process of the invention is not limited thereto but is applicable to the removal of stains from dyed cellulosic fabrics such as cotton and to fabrics consisting of blends of cellulosic fibers with polyester fibers such as the cotton-polyester and rayon-polyester fibrics. The processes of the invention are in general suited to washing fabrics such as linens or garments by machine, by hand or in boiler tubs, but the processes are particularly satisfactory where machines are used particularly commercial clothes washing machines. Optionally, the fabrics can be subjected to a pretreatment for rust removal utilizing an acid sour such as an acid fluoride as illustrated by sodium bifluoride or sodium silicofluoride. As an alternative to such acid sours of the fluoride type, oxalic acid is an effective agent for use in the pretreatment of fabrics which are subsequently to be treated in accordance with the processes of the invention. Similarly, an acid sour is optionally utilized subsequent to stain removal from fabrics treated in accordance with the processes of the invention in order to neutralize alkalies remaining in the fabric subsequent to rinsing.

In the sequential or simultaneous treatment of fabrics in accordance with the processes of the invention to remove stains from dyed or nondyed fabrics such as polyester-cotton, it is necessary to utilize at least one non-ionic or anionic surface-active agent in combination with either or both the chlorine-releasing bleaching agent and the oxygen-releasing bleaching agent. The preferred non-ionic surface active agents are polyoxyethylene or polyoxyalkylene ethers of higher alcohols and higher alkyl phenols and mixtures thereof. These surface active agents can be prepared, for example, by the reaction of said alcohol or alkyl phenol with ethylene oxide or a mixture of ethylene oxide and propylene oxide at temperatures at about 120° to 200° C. in the presence of an alkaline catalyst. The higher (fatty) alcohols and higher alkyl phenols utilized have about 5 to about 18 carbon atoms in the alkyl portion of the compound, preferably 12 to 18 carbon atoms in the fatty alcohols. The number of moles of ethylene oxide added during the reaction to prepare the polyoxyethylene chain portion of the non-ionic surface active agent is about 6 to about 15 moles, and preferably is about 8 to about 12 moles. The most preferred non-ionic surface active agents are the polyoxyalkylene or polyoxyethylene ethers of the higher alcohols containing about 12 to about 18 carbon atoms in and about 8 to about 12 ethylene ether groups or a heteric mixture of about 8 to about 12 polyoxyalkylene groups. Generally said heteric mixture is in the proportion by weight of about 90:10 parts to about 10:90 parts of ethylene oxide and propylene oxide. Preferably a 70:30 proportion by weight respectively of ethylene oxide to propylene oxide is used. Examples of useful non-ionic surface active agents include octylphenyl-polyethoxyethanol, diisobutylphenylpolyethoxyethanol, and isooctylphenylpolyethoxyethanol.

The preferred anionic surface-active agents are the alkylbenzenesulfonic acids and alkylbenzenesulfonates having 10 to 18 carbon atoms in the alkyl group. Because the linear chain alkylbenzenesulfonates and sulfonic acids are readily biodegradable, these are preferred to the branched chain forms. The alkali metal, alkaline earth metal, and amine salts of the alkylbenzenesulfonic acids are useful, particularly the sodium salt of linear dodecyl-benzenesulfonate. Thus the sodium, lithium, and potassium salts; the calcium, barium magnesium, and strontium salts; and the triethanolamine salts of alkylbenzenesulfonic acids are useful anionic surface active agents.

A weight concentration of about 0.01 percent to about 0.25 percent of the above-described surface active agent is necessary for adequate stain removal in aqueous washing solutions containing either or both the chlorinereleasing bleaching agent of the invention or the oxygenreleasing bleaching agent of the invention. Concentrations substantially in excess of about 0.25 percent by weight provide no additional advantage with respect to stain removal in the process of the invention and are impractical from an economic viewpoint. The preferred concentration of the anionic or non-ionic surface active agent is about 0.05 to about 0.15 percent by weight.

The oxygen-releasing compounds useful in the process of the invention are generally used at a concentration of 0.01 percent by weight to about 2 percent by weight and are solid peroxygen compounds which liberate hydrogen peroxide as well as inorganic perhydrates. When dissolved, these compounds liberate hydrogen peroxide enclosed in their crystal lattice (e.g., the alkali metal and alkaline earth metal perborates, perphosphates, per-silicates) and alkali metal and alkaline earth metal per-oxides which yield hydrogen peroxide by hydrolysis (e.g., sodium, lithium and potassium peroxide or the alkali metal and alkaline earth metal percarbonates) which are well known compositions for use in commercial laundering practice. Hydrogen peroxide is also useful in the process of the invention. Additional examples of solid peroxygen compounds which are useful in the present process are alkali metal and alkaline earth metal perborates such as zinc perborate, sodium, lithium, and potassium perborate and other alkali metal per- compounds such as the alkali metal and alkaline earth metal percarbonates, persilicates, perphosphates, and perpyrophosphates. In addition, such compounds as sodium peroxide, zinc peroxide, calcium peroxide, magnesium peroxide, urea peroxide and other metal compositions are useful and included within the term "solid peroxygen compounds". Sodium perborate tetrahydrate, sodium perborate monohydrate and sodium carbonate peroxide are also useful. At least one of said oxygen-releasing compounds is required in the process of the invention.

The chlorine-releasing bleaching agents of the invention are generally used at a concentration of 0.01 percent to about 1 percent by weight and are alkali metal hypochlorites and alkaline earth metal hypochlorites. Preferably sodium hypochlorite is utilized in the process. Other chlorine-releasing agents are 1,3-dichloro-5,5-di-methylhydantoin and the chlorinated alkali metal isocyanurates. Mixtures of said chlorine-releasing bleaching agents are also useful. Representative isocyanurates which are commercially available are, for example, potassium dichlorocyanurate, sodium dichloroisocyanurate. Alternatively, the chlorinated isocyanuric acids are useful.

It is theorized that when stained linens and garments are treated according to the process of the invention and subjected, for instance, to oxidation in the presence of at least one anionic or non-ionic surfactant by an oxygen-releasing bleaching agent followed by the further oxidation in the presence of a said surfactant by a chlorine-releasing bleaching agent, the stains are in a substantial quantity converted to a soluble form and removed in the rinse water. The fatty acid based stains contained thereon are converted to the corresponding fatty acids, i.e., saponified by the influence of the alkalinity provided in the aqueous solution of the aqueous bleaching compositions of the invention. In the course of the bleaching process of the invention, the remaining stains are decolorized.

As builders for use in the process of the invention, one or more conventional prior art water-soluble builder salts can be used. Suitable builder salts are selected from the group consisting of at least one of the alkali metal phosphates including polyphosphates and pyrophosphates, silicates, carbonates, sulfates and borates. Representative builders are trisodium phosphate, tetrasodium pyrophosphate, sodium acid pyrophosphate, sodium tripolyphosphate, sodium monobasic phosphate, sodium dibasic phosphate, sodium hexametaphosphate, sodium silicates, sodium carbonate, sodium sulfate, and borax.

The preferred builder salts are the alkali metal carbonates, sulfates, silicates and borates wherein the alkali metal is sodium, potassium or lithium. The alkali metal polyphosphate builder salts are not desirable where the avoidance of pollution of streams and rivers is a consideration. The alkali metal polyphosphate builder salts are generally desirable for use in complexing calcium and magnesium ions found in hard water and thus preventing the formation of insoluble salts which tend to deposit upon the fabric being washed during the washing cycle. The alkali metal polyphosphate builder salts also enhance detergent efficiency and aid in controlling sudsing and in keeping soil suspended in the washing bath subsequent to removal from the soiled fabric.

Other conventional adjuvants which are utilized in washing fabrics to control foam and improve cleaning properties can be utilized in the process of the invention in conventional amounts. These include soil-suspending polymeric compositions, various fluorescent whitening agents or brighteners and various other adjuvants such as bactericides, fungicides, dyes, water-dispersible pigments, chelating agents, starches, softeners such as those illustrated by the higher fatty acid amides such as coconut or lauric monoethanolamide, isopropanolamide and the like, various organic solvents such as kerosene, xylene or toluene, organic solubilizing agents such as ethanol, ethylene glycol and hexalene glycol, soil-suspending polymers such as sodium carboxymethylcellulose and polyvinyl alcohol, optical and fluorescent brightening materials, coloring agents, corrosion inhibiting agents, germicides, perfume, blueing agents, and the like. The proportions by weight of the builder salts and of the adjuvant ingredients is not critical and may be selected in accordance with the usual prior art practice, varying the proportion of builder, for instance, with the load which is being washed. The builder salts, whether organic or inorganic, can be employed in the concentrations of about 0.10 percent to about 1.0 percent by weight, preferably about 0.50 percent to about 1.0 percent by weight of the washing composition.

A representative dual bleaching and washing composition which when utilized will remove various stains, especially blood stains, from linens and garments, particularly those garments made from cotton and polyestercotton, includes a non-ionic surface active agent in the amount of 1.25 parts by weight, sodium perborate tetrahydrate in the amount of 1.5 parts by weight, sodium dichloroisocyanurate in the amount of 1 part by weight made up to a washing composition containing 1200 parts by weight of water. Such a washing composition would be suitable for washing a 300 pound load of soiled fabrics. Optionally before and after dual bleaching in accordance with the process of this invention, an acid sour is used as a pretreatment and post-treatment. This can be a mixture of 1200 parts by weight of water with 50 parts by weight of sodium bifluoride and 50 parts by weight of sodium silicofluoride. Generally about 0.02 percent to about 0.08 percent by weight of acid sour in aqueous solution is used at a pH of about 1 to about 7 at a temperature of about 120° F. to about 180° F. for a time of about 2 minutes to 15 minutes. It will be understood that the foregoing composition is given solely for purposes of illustration and departures from these specific proportions of ingredients can be dictated by the specific circumstances under which the composition is used and based upon the specific end requirements of the user.

The process of the invention including the use of bleaching and detergent components is generally effective in the highly alkaline pH range yet results in the virtual absence of risk of damage to the fabrics washed. The preferred pH range can be readily obtained by th addition of suitable alkalies and alkaline buffering agents to the bleaching and detergent solutions. The effectiveness of the bleaching and detergent composition at relatively high pH does not prevent the advantageous use of these ingredients in combination with a large number of supplemental ingredients such as soil stabilizers, softeners, and starches. Generally, a pH within the range of about 9 to about 12 is utilized in the process of the invention. Generally, a pH in the range of about 11 to about 12 is utilized in the process of the invention wherein the oxygen-releasing bleaching agent and the chlorine-releasing bleaching agent are utilized simultaneously. Where the chlorine-releasing bleaching agent and the oxygen-releasing agent art utilized in successive bleaching steps, the pH of the washing solution containing the chlorine-releasing bleaching agent is generally at a pH of about 10 to about 11 and the solution containing the oxygen-releasing bleaching agent is generally at a pH of about 10 to about 12, preferably about 11 to about 12, and most preferably about 11.5. The pH of the solution containing the chlorine-releasing bleaching agent when used in a washing step separate from the use of the oxygen-releasing bleaching agent, is preferably about 10.2 to about 10.8 and most preferably about 10.5. It is noted that the activation of the chlorine-releasing bleaching agent is generally enhanced by lowering the pH but the pH should not be lowered to such an extent that the release of chlorine becomes uncontrollable, that is, at below pH 9.

While the temperature of the washing and bleaching solution utilized, as well as the time for each cycle, depends to some extent upon the wash load and upon the concentrations of the bleaching and detergent ingredients, as well as upon the pH range at which these ingredients are utilized, generally the temperature of washing and bleaching is about 160° l F. to about 190° F., it being unnecessary to subject the fabrics to a boil in contact with the bleaching agents and surface active agents of the invention as is the case in certain prior art bleaching processes. The time cycles utilized in washing and bleaching fabrics in accordance with the process of the invention can vary generally between about 30 minutes to about 90 minutes and preferably is about 40 minutes to about 1 hour. The washing time, as stated above, includes, in addition to a simultaneous bleach cycle or successive bleaching cycles, an optional rust removal cycle at the start of the washing procedure interspersed with flushing and rinsing cycles and finally an optional acid sour cycle which can optionally include a fabric softener. Generally the time for bleaching is about 5 minutes to about 30 minutes, preferably about 10 minutes to about 20 minutes and most preferably about 15 minutes. Where the oxygen-releasing bleaching agent and the chlorinereleasing bleaching agent are utilized simultaneously in the same cycle, there is no need to extend the bleach cycle beyond 15 minutes, however, where the oxygen-releasing bleach agent and the chlorine-releasing bleach agent are used successively, each bleach cycle is preferably about 15 minutes long.

The concentration of the oxygen- and chlorine-releasing bleaching agent has been given above but it will be understood that the effectiveness of such agent is dependent ultimately upon the available chlorine or active oxygen that such agent provides. Use of said agents uncontaminated is therefore desirable to insure satisfactory stain removal results.

As is well known, a process for bleaching fabrics or removing stains therefrom is not commercially satisfactory if the stains are removed from the fabric at the cost of reducing the absorbency of the fabric or degrading the fibers, particularly cotton fiber, as a result of the bleaching process. The process of the invention therefore is particularly desirable in that the stains can be removed from cotton and cotton-polyester fabrics and other blends of synthetic fibers with cotton or rayon, without substantial reduction in absorbency or degradation of the cellulosic fiber or other fiber as the result of the stain removing process.

The following examples further illustrate the various aspects of the invention but are not intended to limit it. Whiteness is measured using a reflectometer. The washing process of the invention provides excellent whiteness after washing stained fabrics as indicated in Tables I–IV below. When not otherwise specified throughout the specification and claims, temperatures are given in the degrees centigrade and parts, percentages and proportions are by weight.

In the following examples, a 25 pound washer-extractor set to use the regular level of water was utilized together with a 15 pound dummy load of cotton fabric and various stained swatches of fabric as indicated below:

TFI-R: 65/35 polyester-cotton fabric with crease resistant finish containing carbon soil.

TFI-NR: 65/35 polyester-cotton fabric with no finish containing carbon soil.

TFI-C: 100% cotton fabric containing crease resistant finish and carbon soil.

BMI: blood, milk, ink-stained cotton fabric.

CMS: cocoa, milk and sugar stained cotton fabric.

EMPA-101: cotton fabric containing carbon soil held by oil.

EMPA-115: cotton fabric containing a bleach-sensitive dye.

Swatch A: all cotton fabric with blood stain, dried overnight before testing.

Swatch B: all cotton fabric with blood stains, cured 1 hour at 105° C. before bleaching.

Swatch C: polyester-cotton fabric (65/35) with blood stains, dried overnight before bleaching.

Swatch D: polyester-cotton fabric, 65/35 with blood stains, cured 1 hour at 105° C. before bleaching.

Swatch M: cotton fabric with household stains as follows: (1) gentian violet, (2) Worcestershire sauce, (3) blueberry juice, (4) Kiwi shoe polish, (5) French dressing, (6) tincture of Merthiolate, (7) mustard. These stains were applied to the fabric and dried overnight before bleaching.

Swatch N: polyester-cotton fabric, 65/35 percent respectively, treated with crease-resistant resin finish with similar stains as in Swatch M. These stains were dried over night prior to the bleaching.

Swatch Y: cotton fabric with stains from (1) tomato sauce, (2) pizza sauce, and (3) spaghetti sauce. These stains were cured onto the fabric by heating at 105° C. for 1 hour.

Swatch Z: polyester-cotton, 65/35 fabric with similar sauce stains as in Swatch Y. These stains were cured onto the fabric by heating the fabric to a temperature of 105° C. for a period of 1 hour.

EXAMPLE I (Control)

A prior art bleaching procedure was performed utilizing a Milnor washer-extractor of 25 pound capacity containing a 15 pound cotton fabric dummy load and all the stained swatches listed above, 4 ounces of sodium perborate tetrahydrate and 4 ounces of sodium sesquicarbonate were added to the washer containing the regular level of water at a temperature of 180° to 190° F. and the fabrics were allowed to bleach for a period of 15 minutes. This bleach cycle was followed by four 2-minute aqueous rinse cycles at temperatures descending in order from 180° F. through 160°, 140°, 120° F. followed by a 5 minute acid sour at a temperature of 100° F. utilizing the regular level of water and 14 grams of sodium silicofluoride. The sour was followed by a 1 minute extraction cycle and tumble drying 15 minutes at 160° Fahrenheit. Whiteness was evaluated by reflectometer with results shown in Tables I–IV.

EXAMPLE II (Control)

A bleaching process of the prior art was performed by adding to the regular level of water, 1.54 ounces of sodium sulfate and 0.46 ounces of a chlorine-releasing bleaching agent, trichloroisocyanuric acid in a 25 pound capacity washer containing a 15 pound dummy load of cotton fabric and all the swatches listed above. The pH was 6.0. Following a 10 minute bleach cycle at a water temperature of 160° F., the load was subjected to rinse cycles, an acid sour, extraction, and drying as in Example I.

EXAMPLE III (Control)

A bleaching operation of the prior art was performed using a 25 pound capacity washer-extractor at the regular level of water and containing a 15 pound dummy load of cotton fabric and all the stained swatches listed above. Four ounces were added of a commercially available, built detergent having a total alkalinity as $Na_2O$ of 53.1% by weight and a pH of a ½ percent by weight aqueous solution at 75° F. of 12 which contains a blend of surface active agents namely, 3% by weight of the anionic surface active agent, linear dodecyl benzene sulfonic acid and 5% by weight of the non-ionic surface active agent prepared by the mixed alkoxylation of a $C_{12}$–$C_{15}$ blend of linear primary alcohols with a 70:30 weight ratio respectively of ethylene oxide and propylene oxide to obtain a product having 25% by weight of primary alcohol residue. Then 4 ounces of sodium perborate tetrahydrate and 4 ounces of sodium sesquicarbonate were added to the washer at a water temperature of 180° to 190° F. and the load was allowed to bleach for a period of 15 minutes. Subsequently, the load was rinsed, acid soured, extracted, and dried as in Example I.

EXAMPLE IV (Control)

Utilizing a 25 pound washer-extractor set for regular water level together with a 15 pound dummy load of cotton fabric and all the stained swatches listed above, a chlorine-bleaching step was performed in accordance with prior art practice by adding 4 ounces of the commercially available built detergent of Example III together with 1.54 ounces of sodium sulfate and 0.46 ounce of trichloroisocyanuric acid at a water temperature of 160° F., a pH of 10.5 and bleaching for a period of 10 minutes. Subsequently, the load was subjected to rinsing, acid souring, extraction, and drying as in Example I.

EXAMPLE V

Utilizing a 25 pound washer-extractor set for regular water level together with a 15 pound dummy load of cotton fabric and all the stained swatches listed above, 4 ounces of the built detergent of Example III together with 4 ounces of sodium perborate tetrahydrate, 4 ounces of sodium sesquicarbonate, 1.54 ounces of sodium sulfate and 0.46 ounce of trichloroisocyanuric acid were added to the washer at a water temperature of 175° F. and the load was allowed to bleach and wash for a period of 15 minutes. Subsequently, the load was subjected to rinsing, acid souring, extraction, and drying as in Example I.

EXAMPLE VI

Utilizing a 25 pound washer-extractor set for regular water level and a 15 pound dummy load of cotton fabric together with all the swatches as listed above, 4 ounces of the built detergent of Example III together with 4 ounces of sodium sesquicarbonate and 4 ounces of sodium perborate tetrahydrate were added to the washer at a temperature of 180° to 190° F. at a pH of 11.0 to 11.5 and the load was allowed to bleach for a period of 15 minutes. Subsequently, the washer was set to flush for a period of 2 minutes utilizing water at a temperature of 180° F. Next, 4 ounces of the built detergent of Example III together with 2 ounces of sodium trichlorocyanurate was added at a temperature of 160° F. and a pH of 10.5 and the load was allowed to bleach for a period of 10 minutes. Thereafter, the load was rinsed, soured, extracted, and dried as in Example I.

Table I

| Bleaching and Washing Conditions | Reflectance* After Washing and Bleaching of Commercially Prepared Test Panels | | | | | | |
|---|---|---|---|---|---|---|---|
| | TFI-R | TFI-NR | TFI-C | Empa 101 | Empa 115 | BMI | CMS |
| Example 1 | 14 | 14 | 6 | 7 | 9 | 1 | 0 |
| Example 2 | 8 | 2 | 3 | 0 | 42 | 1 | 5 |
| Example 3 | 19 | 14 | 14 | 9 | 7 | 1 | 2 |
| Example 4 | 19 | 8 | 13 | 12 | 30 | 16 | 11 |
| Example 5 | 28 | 21 | 18 | 13 | 8 | 2 | 4 |
| Example 6 | 48 | 28 | 22 | 24 | 42 | 8 | 27 |

*using Hunter lab D-40 reflectometer average of 8 readings reported

Table II

| Reflectance After Washing and Bleaching of Blood-Stained Test Panels | | | | | | |
|---|---|---|---|---|---|---|
| | Bleaching and Washing Conditions | | | | | |
| Test Panel | Example 1 | Example 2 | Example 3 | Example 4 | Example 5 | Example 6 |
| A | 16 | 30 | 38 | 25 | 52 | 44 |
| B | 10 | 21 | 18 | 15 | 59 | 30 |
| C | 4 | 18 | 6 | 23 | 40 | 26 |
| D | 18 | 8 | 16 | 10 | 26 | 15 |

Table III

| Reflectance After Washing of Test Panels Stained with Common Household Stains | | | | | | |
|---|---|---|---|---|---|---|
| | Bleaching and Washing Conditions | | | | | |
| Test Panel M | Example 1 | Example 2 | Example 3 | Example 4 | Example 5 | Example 6 |
| Stain 1 | 68 | 76 | 79 | 81 | 74 | 82 |
| Stain 2 | 44 | 46 | 47 | 47 | 49 | 50 |
| Stain 3 | 48 | 51 | 51 | 51 | 50 | 51 |
| Stain 4 | 10 | 27 | 12 | 20 | 11 | 20 |
| Stain 5 | 17 | 22 | 24 | 24 | 23 | 22 |
| Stain 6 | 31 | 35 | 34 | 35 | 35 | 38 |
| Stain 7 | 44 | 32 | 48 | 52 | 47 | 52 |
| Test Panel N | | | | | | |
| Stain 1 | 55 | 59 | 60 | 58 | 59 | 59 |
| Stain 2 | 34 | 38 | 38 | 38 | 38 | 39 |
| Stain 3 | 54 | 56 | 56 | 57 | 55 | 59 |
| Stain 4 | 10 | 18 | 15 | 20 | 14 | 20 |
| Stain 5 | 10 | 15 | 19 | 21 | 20 | 21 |
| Stain 6 | 29 | 31 | 29 | 34 | 34 | 33 |
| Stain 7 | 37 | 34 | 38 | 40 | 39 | 39 |

Table IV

| Reflectance After Washing and Bleaching of Commercially Prepared Sauces on Fabrics | | | | | | |
|---|---|---|---|---|---|---|
| | Bleaching and Washing Conditions | | | | | |
| Test Panel Y | Example 1 | Example 2 | Example 3 | Example 4 | Example 5 | Example 6 |
| Stain 1 | 70 | 78 | 68 | 77 | 63 | 78 |
| Stain 2 | 64 | 79 | 63 | 75 | 59 | 69 |
| Stain 3 | 50 | 56 | 47 | 50 | 47 | 54 |
| Test Panel Z | | | | | | |
| Stain 1 | 63 | 63 | 66 | 67 | 63 | 67 |
| Stain 2 | 64 | 66 | 65 | 67 | 64 | 70 |
| Stain 3 | 48 | 57 | 47 | 53 | 54 | 61 |

Results shown in Table I illustrate the generally superior washing and bleaching performance of the process of the invention illustrated by Examples 5 and 6. The test panel designated BMI, i.e., blood, milk, and ink-stained cotton fabric appears whiter using the prior art procedure of Example 4.

Comparison of whiteness results shown in Table II indicates the substantial superiority of the process of the invention (Examples 5 and 6) as compared to prior art washing and bleaching methods. Synergism is suggested by these results.

As shown in Tables III and IV, the process of the invention is not substantially more effective in stain removal of common household stains and prepared sauces than the processes of the prior art which makes the observed results shown in Table II, which suggest synergism, all the more unexpected.

While this invention has been described with reference to certain specific embodiments, it will be recognized by those skilled in the art that many variations are possible without departing from the scope and spirit of the invention and it will be understood that it is intended to cover all changes and modifications of the invention, as disclosed herein for the purposes of illustration, which do not constitute departure from the spirit and scope of the invention.

The embodiments of the invention in which an exclusive property or privilege is claimed are defined as follows:

1. A method of reclaiming stained cellulosic and cellulosic-polyester blend textile fabrics by a washing and bleaching process comprising: bleaching said textile fabrics in an aqueous solution of at least one anionic or non-ionic surface-active agent at a concentration of about 0.01 percent to about 0.25 percent by weight in admixture with (a) about 0.01 percent to about 1 percent by weight of a chlorine-releasing agent and (b) about 0.01 percent to about 2 percent by weight of an oxygen-releasing agent at a pH of about 9 to about 12, a temperature of about 160° F. to about 190° F. for a period of time of about 5 minutes to about 30 minutes.

2. The method of claim 1 wherein said process includes a pre-treatment with a rust-removing acid sour at a pH of about 1 to about 7, at a temperature of about 120° F. to about 180° F. for a period of time of about 2 minutes to about 15 minutes.

3. The method of claim 2 wherein said process includes a post-treatment with an acid sour and said acid sour is an acid fluoride salt selected from the group consisting of sodium silicofluoride and sodium bifluoride.

4. The method of claim 2 wherein said acid sour is oxalic acid.

5. The process of claim 2 wherein said bleaching solution contains an alkaline builder.

6. The method of claim 2 wherein said fabric is (a) a cotton or polyester-cotton blend fabric containing blood stains or (b) said fabric containing blood stains and treated with a synthetic resin, wrinkle-resistant finish.

7. The method of claim 2 wherein said chlorine-releasing bleaching agent is selected from the group consisting of alkali metal and alkaline earth metal hypochlorites, chlorinated hydantoins, chlorinated alkali metal isocyanurates, chlorinated isocyanuric acid, and mixtures thereof, and wherein said oxygen-releasing bleaching agent is selected from the group consisting of at least one of hydrogen peroxide, and a peroxygen compound.

8. A method of reclaiming, by a washing and bleaching process, stained fabrics consisting of cotton, cotton-polyester blends and rayon-polyester blends at a pH of about 9 to about 12 and a temperature of about 160° F. to about 190° F. comprising the sequential aqueous treatment, of said fabrics in two stages with a chlorine-releasing agent and an oxygen-releasing agent in any order, wherein in each stage, said bleaching agent is present in an aqueous solution in the presence of about 0.01 percent to about 0.25 percent by weight of at least one anionic or non-ionic surface active agent, and wherein said oxygen-releasing agent is present in the concentration of about 0.01 percent to about 2 percent by weight and is selected from the group consisting of at least one of hydrogen peroxide, alkali metal and alkaline earth metal perborates, percarbonates, persilicates, and peroxides and wherein said chlorine-releasing bleaching agent is present in the concentration of about 0.01 percent to about 1 percent by weight and is selected from the group consisting of the alkali metal hypochlorites, the alkaline earth metal hypochlorites, dichlorodimethylhydantoin, the chlorinated alkali metal isocyanurates, the chlorinated isocyanuric acids, and mixtures thereof.

9. The method of claim 8 wherein said stained fabric is pre-treated with a rust-removing sour comprising an aqueous solution of an acid fluoride salt selected from the group consisting of sodium silicofluoride and sodium bi-fluoride or oxalic acid, said solution having a pH of about 1 to about 7 and at a temperature of about 120° F. to about 180° F., said pre-treatment being for a period of time between 2 minutes to about 15 minutes.

10. The method of claim 8 wherein said aqueous solution of a chlorine-releasing bleaching agent and an oxygen-releasing bleaching agent contains an alkaline builder.

11. The method of claim 10 wherein said builder is selected from the group consisting of at least one of the alkali metal and alkaline earth metal phosphates including polyphosphates and pyrophosphates, silicates, carbonates, sulfates, and borates.

12. The method of claim 8 wherein said fabric is (a) a cotton or polyester-cotton blend fabric containing blood stains or (b) said fabric containing blood stains and treated with a wrinkle-resistant synthetic resin finish.

13. The method of claim 8 wherein said non-ionic surface active agent is selected from the group consisting of polyoxyethylene and polyoxyalkylene ethers of higher alcohols and higher alkyl phenols, and mixtures thereof.

14. The method of claim 8 wherein said chlorine-releasing agent is trichloroisocyanuric acid and wherein said oxygen-releasing agent is sodium perborate tetrahydrate.

* * * * *